United States Patent [19]

Cheney

[11] Patent Number: 4,763,757

[45] Date of Patent: Aug. 16, 1988

[54] SAW HORSE

[76] Inventor: Kirk S. Cheney, 236 Havelock Street, Toronto, Ontario, Canada

[21] Appl. No.: 97,145

[22] Filed: Sep. 16, 1987

Related U.S. Application Data

[63] Continuation-in-part of Ser. No. 24,760, Mar. 11, 1987, abandoned.

[51] Int. Cl.[4] ..... B27B 21/00

[52] U.S. Cl. ..... 182/21; 182/33; 182/46; 182/153

[58] Field of Search ..... 182/46, 129, 152, 153, 182/159, 181, 225, 33, 35, 21; 108/112, 113; 297/42, 45

[56] References Cited

U.S. PATENT DOCUMENTS

| | | | |
|---|---|---|---|
| D. 213,400 | 2/1969 | Cannon . | |
| 493,479 | 3/1893 | Carl . | |
| 1,625,294 | 4/1927 | Whitesides | 108/113 |
| 1,943,871 | 1/1934 | Landberg | 182/152 |
| 4,113,056 | 9/1978 | De Lorenzo | 182/153 |
| 4,124,093 | 11/1978 | Breisch | 182/181 |
| 4,296,834 | 10/1981 | Korger . | |
| 4,319,663 | 3/1982 | Barden . | |
| 4,403,678 | 9/1983 | Zieg . | |
| 4,437,413 | 3/1984 | O'Brien | 182/152 |
| 4,534,447 | 8/1985 | Champigny | 182/152 |
| 4,638,885 | 1/1987 | Frederick | 182/181 |

*Primary Examiner*—Reinaldo P. Machado
*Attorney, Agent, or Firm*—George A. Rolston

[57] ABSTRACT

A support device having two end members, a pair of spacer members with hinges at their outer ends and intermediate hinges at their inner ends and swingable between a stored position and an extended position, a pair of transverse support panels with hinges at their outer ends and intermediate hinges at their inner ends, the support panels being swingable between an upwardly stored position, and a downwardly extended position in which they lie in a common transverse plane, adjacent the upper edges of the spacer members, with the support panels resting on the upper edges of the spacer members.

11 Claims, 4 Drawing Sheets

SAW HORSE

This application is a continuation-in-part of United States patent application Ser. No. 024,760, filed Mar. 11, 1987, entitled SAW HORSE in the name of Kirk S. Cheney (now abandoned).

The invention relates to a support device such as a saw horse or trestle of the type which is portable and foldable.

BACKGROUND OF THE INVENTION

A saw horse or trestle usually consists of two pairs of legs arranged more or less in the shape of a triangle, and a cross member extending between them. Such devices may be used for sawing lumber, or may be used in pairs or more for supporting a table surface.

It is a common experience that such articles must be transported from one work site to another, in order to provide a support for whatever work is being done at a particular location. For this purpose, it is clearly desirable that the support shall be collapsbile so that it occupies a small space, and can be transported easily. Similarly, it is clearly desirable that at the new work site it shall be capable of being readily erected without the use of tools to provide a rigid stable support.

Another factor in the design of such support is the variety of uses which may be required. Thus it may be desirable to provide at an upper level a support for a work surface such as a table, or some other device at about the height of the hip or waist of the workman. It may also be desirable to use the same device to provide a support at a lower level, for example, about the knee level of the workman to provide a stable surface on which to saw lumber.

Generally speaking, saw horses, trestles and the like in the past have provided only a single level of support, and thus have not been adaptable to the variety of different uses which may be required at any particular site.

BRIEF SUMMARY OF THE INVENTION

With a view to overcoming these various disadvantages, the invention comprises a collapsible portable support device comprising two end members, having lower and upper ends; two spacer members having first and second surfaces, and outer and inner ends; outer hinge means located between said end members and said outer ends of said spacer members; intermediate hinge means connecting said spacer members at said inner ends whereby said spacer members are swingable between extended and stored positions; two transverse support panels having upper and lower surfaces and outer and inner ends; outer hinge means between said end members and said outer ends of said support panels; and intermediate hinge means connecting said inner ends of said support panels, said support panels being swingable between an upwardly stored position, and a downwardly extended position in which they lie in a common transverse plane, and wherein said common plane is adjacent said upper edges of said spacer members, with said lower surfaces of said support panels resting on said upper edges of said spacer members.

More particularly, it is an objective of the invention to provide a support device having the foregoing advantages including engagement means on the upper ends of the end members in order to receive opposite ends of a continuous cross bar, such cross bar being removable to permit work to be done on said upper surface of said support panels, as well as for, or to use the upper panel as a seat, or standing platform collapsing, storage, or travel.

It is a further objective of the invention to provide a support device of the type described, formed of thermoplastic materials with integrally moulded interfitting hinge components.

It is a further objective of the invention to provide a support device of the type described which may also be used as a step ladder or as a seat.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
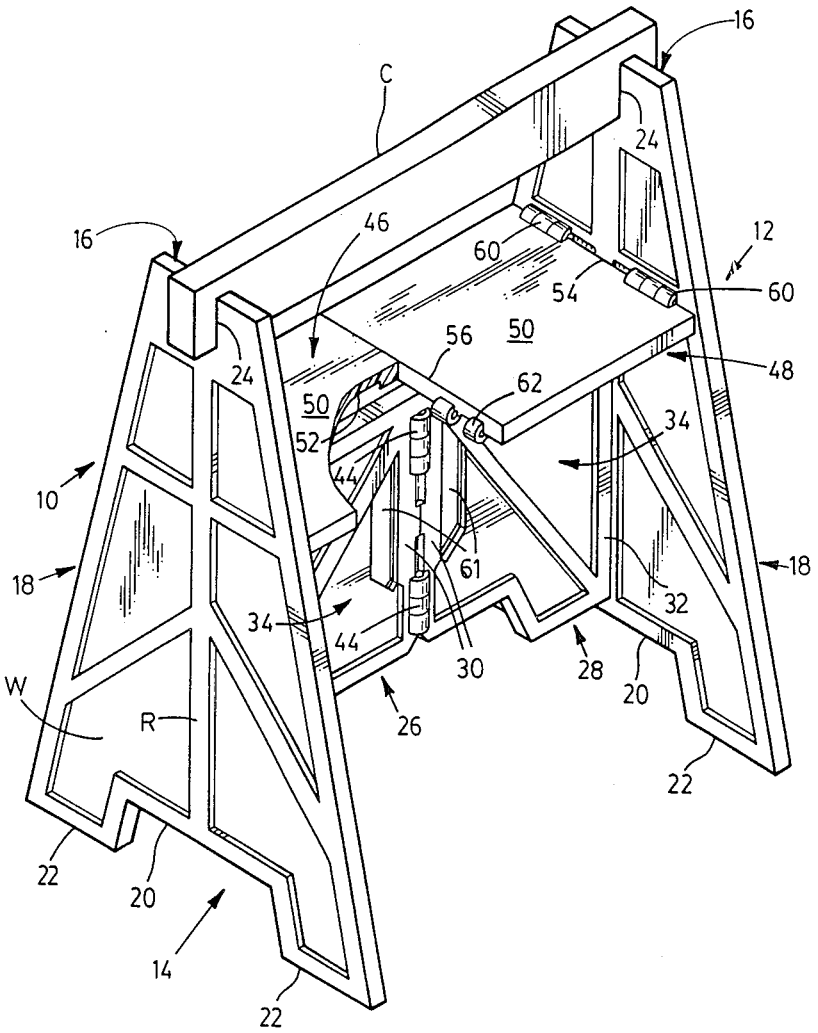
FIG. 1 is a perspective illustration of the support device according to the invention shown in its erect extended position.
Figure 2:
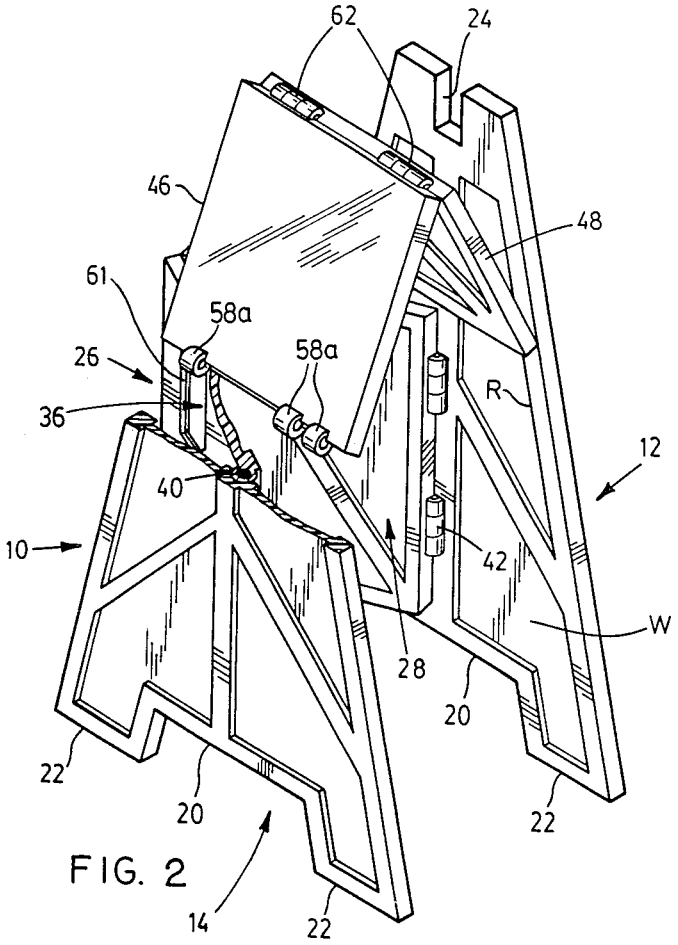
FIG. 2 is a cut-away perspective of the support in a partially folded condition.

From the drawings it will be noted that the support device according to the invention has the general appearance of a saw horse. That is to say, it may be used as a support by a workman when cutting or working on a work piece such as wood or metal.

It will however be appreciated that the invention is equally applicable to use as a support such as a trestle for a table. Two or more support devices according to the invention may simply be erected side by side and a panel of any suitable material may be placed on top. As will also appear from the following description, the invention may provide support for a work piece at different heights so as to facilitate a workman carrying out different forms of work at different times.

It will thus be seen that the invention has multiple uses.

Referring to the drawings in more detail, the support device according to the invention comprises two end members 10 and 12 each of a generally triangular shape. Each of the end members has a lower edge 14 and an upper edge 16, and two side edges 18. In the lower edge there is a notch 20 defining two feet 22, and in the upper edge there is a notch 24 adapted to receive a common 2×4 cross member indicated generally as C.

A pair of generally upright spacer members or panels 26 and 28 are provided between the end members 10 and 12. The panels 26 and 28 each have inner ends 30 and outer ends 32. They further define surfaces which for the purposes of the present description are defined as front and rear surfaces 34 and 36. It will however be appreciated the terms outer and inner and front and rear are used herein merely for the sake of convenience in reference to the drawings, and without any limitation being intended thereby.

Two pairs of outer hinges 40–40 and 42–42 connect between the outer ends of respective spacer panels 26, 28 adjacent the rear surface 36 of each panel, and respective end members 10 and 12. In this way the spacer panels may swing rearwardly, (again the term being used without any limitation), but may not swing forwardly.

A pair of intermediate hinges 44 connect the inner ends of the two spacer panels, adjacent their front surfaces.

In this way, by the use of three pairs of hinges, located on opposite surfaces in the manner described, the two spacer panels may be swung rearwardly to fold, but when extended will lock in their extended position, and will lie in a common plane.

Figure 5:
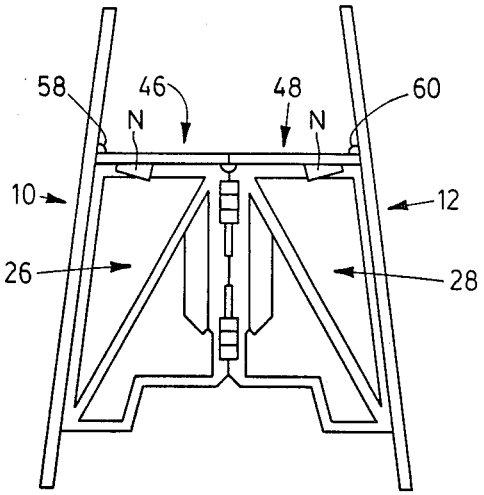
FIG. 5 is a side elevation showing the support with angled end members.

The outer ends 32 of the spacer members are usefully formed at a slight inclination or angle (FIG. 5) whereby to support the end members 10 and 12 at a slight inclination inwardly, converging from bottom to top. This gives the entire device somewhat greater stability.

In accordance with the invention, the support device further comprises two generally horizontally arranged support panels 46 and 48, each having upper surfaces 50 and lower surfaces 52. The support panels further define outer ends 54 and inner ends 56 and have lengths equal to the lengths of spacer member 26 and 28.

Pairs of outer hinges 58 and 60 connect between the outer ends of respective support panels 46-48 adjacent their upper surfaces 50, and respective end members 10 and 12. A pair of intermediate hinges 62 connects between the two inner ends 56 of the support panels, adjacent their lower surfaces 52. Where the end members are inclined, notches N are formed in the upper edges of the spacer panels, to permit them to fold together without interfering with the support panels, and hinges 58 and 60.

The support panels 46–48 may be swung upwardly to fold, but when swung downwardly they will lock in their horizontally extended position, and lie in a common plane.

It will also be noted that when lying in such common plane, the lower surfaces of the support panels 46–48, will bear on the upper edges of the two spacer panels 26–28. In this way, the two support panels are braced underneath, and provide a stable, level, generally horizontal working surface at about the height of the knee of a workman. This will permit him to support a workpiece, for example, a wooden member, on the support panels, and if necessary brace one hand against the member, while sawing it.

If desirable he could also attach some form of clamp or vise not shown to the support panels for other forms of work. Thus the support panels form a simple form of work bench.

In addition to this use, the invention also permits a cross bar C to be placed in the two notches 24 in the upper ends of the end members, so that this cross bar may provide support for a workpiece at about the height of the waist or hip of a workman.

It will also be apparent that two support devices of the invention, with suitable cross members, can be used as trestles to support a panel of any suitable material and thus form a table.

When moving from place to place, or for storage purposes, the support devices may simply be collapsed by first removing cross bar "C", folding the spacer panels and support panels together, which will then permit the two end members to be sandwiched together on either side of the folded panels.

If desired, some form of carrying handle may be provided on the end members, or hand holes indicated generally as 61 may be formed in the spacer panels 26–28 to act as carrying handle.

Figure 3:
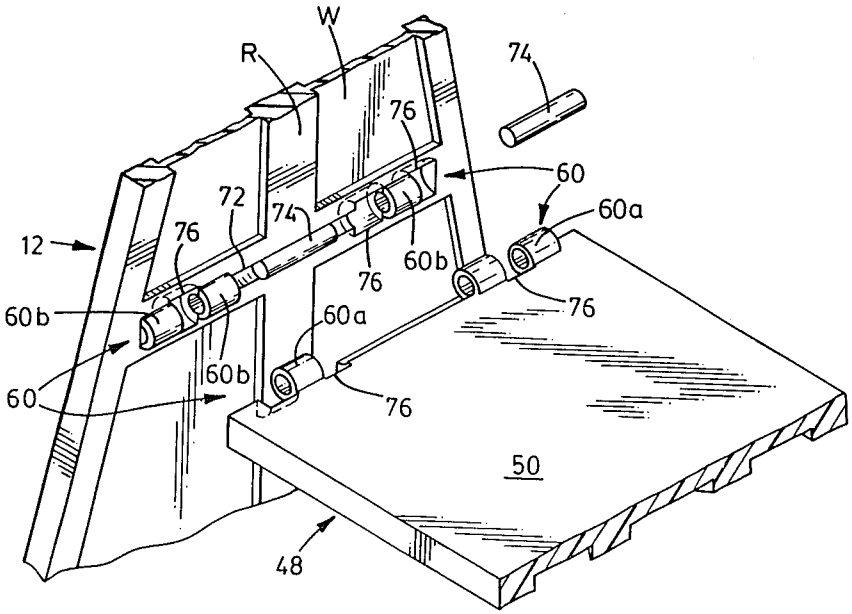
FIG. 3 is an exploded view of a hinge assembly.

Referring more particularly to FIG. 3, it will be noted that the invention may usefully be formed of thermoplastic materials, typically by injection moulding techniques. Such manufacturing techniques offer a low cost yet efficient method of production, and also offer certain advantages in practice. There are four moulds only required: one for end members, one for support panels, and two for spacer members.

In order to provide for such a form of construction, the end members, spacer members and support panels are all formed with a plurality of raised ribs R, and thinner web sections W.

The hinges are made up of mating hinge components formed integrally with the respective members and panels described. A typical hinge formation is shown with reference to FIG. 3 illustrating, by way of example, hinges 60 between end member 12, and support panel 48.

Generally semi-cylindrical hinge sleeve components **60*a* are shown formed on support panel 48 and generally semi-cylindrical hinge components 60*b* are shown formed on end member 12. The components 60*a* and 60*b* are formed either singly or in pairs as shown, so as to mate with one another to form a hinge. In addition this arrangement reduces the number of moulds required, i.e., end members 10 and 12, and panels 46 and 48** are interchangeable.

Registering with the components is an axial groove 72, to facilitate insertion of hinge pins 74.

Semi-cylindrical recesses 76 are formed alongside components **60*a* and 60*b*** to allow interdigital mating of the components, and to provide for a hinge action.

Figure 4:
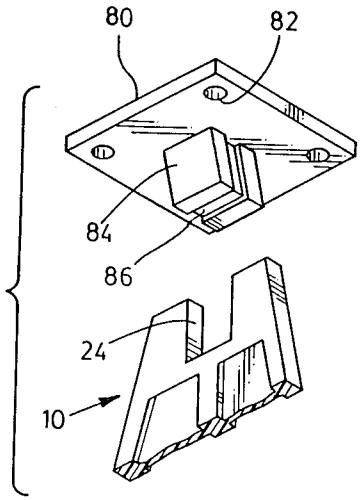
FIG. 4 is a perspective illustration of an accessory for use with the support device shown partially cut away.

Other accessory components may be designed for use with the support device. One such accessory is shown in FIG. 4. It comprises a planar base panel 80, with bolt holes 82, on which any device, such as a vise or the like (not shown) may be secured. On the underside of panel 80, a boss 84 extends downwardly. Boss 84 has a channel-shaped groove 86 adapted to make a snug fit in notch 24 of one of end members 10–12.

Two such accessories may be used to permit a larger device to be clamped or bolted in place.

Figure 6:
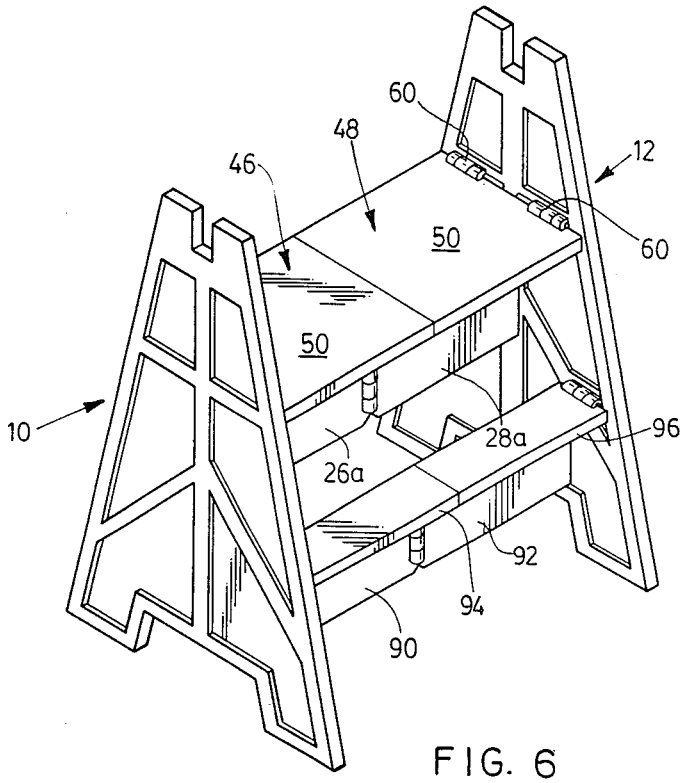
FIG. 6 is a perspective of a further embodiment.

With a further modification (FIG. 6), the device may also be used as a small step ladder.

In this case the modification consists of reducing the depth of the two spacer panels 26–28, as at **26*a*–28*a***, so as to leave a space therebeneath.

A pair of offset spacer panels 90 and 92 are mounted on the end members, offset from the plane of the spacer panels **26*a*–28*a*. A pair of generally horizontal step panels 94 and 96 are attached to the end members by suitable hinge means, in the same way as the support panels 46 and 48**.

It will thus be seen that a workman may step up on the panels 94 and 96 with one foot, and then up on to the two support panels 46 and 48, and this will provide a further use for the invention.

Figure 7:
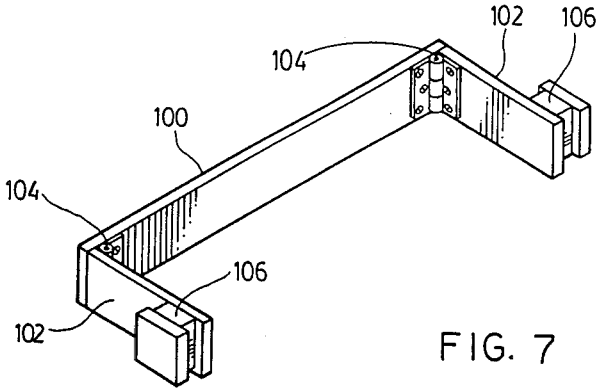
FIG. 7 is a perspective view of a back support attachment.

As shown in FIG. 7, a further attachment may comprise a back support member 100 and two arm members 102. Hinges 104 connect members 100 and 102. Locking abutments 106 are formed on the free ends of arm members 102 and are adapted to fit in the notches 24. The support panels 46, 48 can then be used as a seat.

The foregoing is a description of a preferred embodiment of the invention which is given here by way of example only. The invention is not to be taken as limited to any of the specific features as described, but comprehends all such variations thereof as come within the scope of the appended claims:

What is claimed is:

1. A collapsible portable support device comprising:

two end members, having lower and upper ends;

two spacer members having first and second surfaces, and outer and inner ends;

outer hinge means located between said end members and said outer ends of said spacer members;

intermediate hinge means connecting said spacer members at said inner ends whereby said spacer members are swingable between extended and stored positions;

two transverse support panels having upper and lower surfaces and outer and inner ends;

outer hinge means between said end members and said outer ends of said support panels; and, intermediate hinge means connecting said inner ends of said support panels, said support panels being swingable between an upwardly stored position, and a downwardly extended position in which they lie in a common transverse plane, and wherein said common plane is adjacent said upper edges of said spacer members, with said lower surfaces of said support panels resting on said upper edges of said spacer members.

2. A support device as claimed in claim 1 including engagement means on the upper ends of the end members, to receive opposite ends of a continuous cross bar.

3. A support device as claimed in claim 1 wherein said hinge means interconnect said end members, said spacer members and said support panels in such a way that said spacer members and said support panels, in their extended positions, are swingable only in the direction toward said stored positions thereof, and are locked against swinging in the reverse directions.

4. A support device as claimed in claim 3 wherein said outer hinge means on said spacer members are located adjacent said first surfaces thereof, and said intermediate hinge means on said spacer members are located adjacent said second surfaces thereof.

5. A support device as claimed in claim 4, wherein said outer hinge means on said support panels are located adjacent said upper surfaces thereof and said intermediate hinge means on said support panels are located adjacent said lower surfaces thereof.

6. A support device as claimed in claim 1 including hand holes formed in said spacer panels adjacent their said inner ends and registering with one another.

7. A support device as claimed in claim 1 wherein said hinge means comprise hinge components formed integrally with said end members, said spacer members and said support panels, arranged in interdigitating mating relation, and hinge pin means joining same to form said hinge means.

8. A support device as claimed in claim 2 including a mounting member having a boss, and a recess in said boss, interengageable with a said engagement means.

9. A support device as claimed in claim 1 wherein said end members lie at angles inclined from the vertical, and converge towards one another from bottom to top.

10. A support device as claimed in claim 1 including a pair of step members hingedly connected together along adjacent edges, and respectively hinged on opposite edges to said end members, and a pair of spacer members hingedly connected together along adjacent edges, and hinged to said end members at opposite ends, said spacer members being adapted to support said step members.

11. A support device as claimed in claim 1 and including back support means and attachment means associated therewith for attachment to said end members, whereby said support panels may be used for seating.

* * * * *